United States Patent [19]

King

[11] Patent Number: 5,025,937

[45] Date of Patent: Jun. 25, 1991

[54] SAFETY LOCK FOR RACK SYSTEMS

[75] Inventor: John R. King, West Bloomfield, Mich.

[73] Assignee: S&k Enterprises, Inc., Detroit, Mich.

[21] Appl. No.: 410,809

[22] Filed: Sep. 22, 1989

[51] Int. Cl.[5] ..... A47F 5/00

[52] U.S. Cl. ..... 211/192; 248/222.1; 403/353

[58] Field of Search ..... 211/192, 189; 248/222.1; 403/315, 316, 317, 318, 319, 320, 245, 353

[56] References Cited

U.S. PATENT DOCUMENTS 3,702,137 11/1972 Evans ..... 211/192

3,730,108 5/1973 Stroh ..... 211/192 X 3,986,318 10/1976 McConnell ..... 211/192 X 4,165,944 8/1979 Sunasky ..... 211/192 X

*Primary Examiner*—Robert W. Gibson, Jr.

*Attorney, Agent, or Firm*—Harness, Dickey & Pierce

[57] ABSTRACT

A pallet rack system has a safety lock on end connectors of horizontal beam members to prevent accidental removal of the horizontal beams from the vertical frame supports. The safety lock includes a cross-shaped member rigidly secured to the beam connectors and a U-shaped member associated with the cross-shaped member to operatively couple the U-shaped member with the end connector. The U-shaped member includes a hook which cooperates with an aperture in the frame supports to lock the safety lock device to the frame support which, in turn, locks the horizontal beams with the vertical frame supports.

8 Claims, 2 Drawing Sheets

SAFETY LOCK FOR RACK SYSTEMS

BACKGROUND OF THE INVENTION

The present invention relates to storage racks and, more particularly, to a safety lock for interlocking horizontal beams with vertical frame supports.

A typical pallet rack comprises a frame made of vertical posts which are interconnected by horizontal beams. Rigid slats or sheets may be positioned upon opposing beams to form shelves. Alternatively, the beams may be used alone like shelves. Horizontal platforms, or pallets, loaded with articles to be stored, are positioned upon the opposed beams or slats or sheets spanning the beams, where they are used. In essence, the rack is an open shelving arrangement.

In heavy duty pallet racks or similar types of frames which are utilized to support heavy weights, it is desirous that the beams which extend horizontally between the corner posts and other parts of the frames be maintained in their position. Thus, it is desirous to include a locking device on the horizontal beams to interlock the beams with the frame support posts against accidental withdraw of the beams.

In the past, one piece locking devices have been utilized on the end connectors of the beams. While these one piece locking devices provide satisfactory results, designers are always seeking to improve the art.

SUMMARY OF THE INVENTION

Accordingly, it is an object of the present invention to provide an improved safety lock device for horizontal beams in pallet rack systems.

The safety lock device of the present invention provides the art with a two-piece locking device. The two pieces are easily manufactured by stamping or the like processes from spring steel or similar materials.

The safety lock device has one piece readily adaptable to be affixed to a beam end connector. The second piece is easily installed with the first piece to provide the end connector with a safety locking device.

The two piece safety lock device is relatively inexpensive to manufacture and reduces the tooling cost associated with an intricate die to manufacture a one-piece safety latch.

The two-piece safety lock device provides for on-site assembly of the second member as well as removal and replacement of the second member, if the second member is damaged.

From the following detailed description taken in conjunction with the accompanying drawings and the subjoined claims, other objects and advantages of the present invention will become apparent to those skilled in the art.

DETAILED DESCRIPTION OF THE PREFERRED EMBODIMENT

Figure 1:
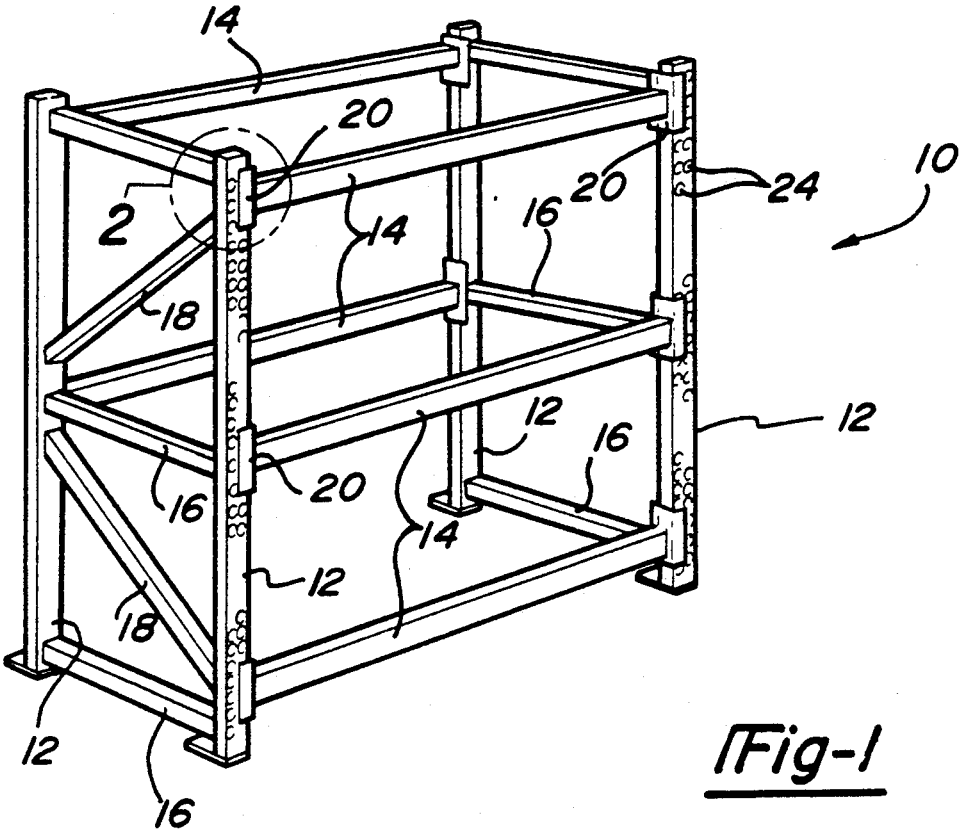
FIG. 1 is a perspective view of a pallet rack assembly in accordance with the present invention.

Referring to the figures, particularly FIG. 1, a typical pallet rack is illustrated and designated with the reference numeral 10. The pallet rack is formed of four vertical frame posts 12 that are interconnected by horizontal front and rear beams 14 and horizontal braces 16. In addition, the posts may be further connected together by angularly arranged cross braces 18 which stiffen the frame. The beams 14 include angle shaped end connectors 20 which include upper, lower and center pins **22*a*, 22*b*, and 22*c*, respectively, which are force fitted or stamped within openings 23 formed in the connectors. These pins are loosely inserted into apertures 24 of the posts 12 to secure the beams 14 onto the frame posts 12. The end connectors 20 also include a safety lock mechanism 30 to lock the beams 14 within apertures 24 on the frame posts 12**.

The safety lock mechanism 30 includes a hold down or cross member 40 and a hook member 60. The members 40 and 60 are generally formed or stamped from spring steel or other strong resilient material. The cross member 40 includes four legs, that is, lower leg 42, transverse legs 44 and 46, and lower leg 48. (see FIG. 3) Leg 42 is relatively larger than the other legs and includes an aperture 50. The aperture 50 enables the cross member 40 to be rigidly secured to the end connector 20 by a center pin **22*c*. The center pin 22*c* is positioned through the aperture 50, in the cross member 40**, and is stamped into place, to expand it, so that it is rigidly secured to the cross member.

Figure 2:
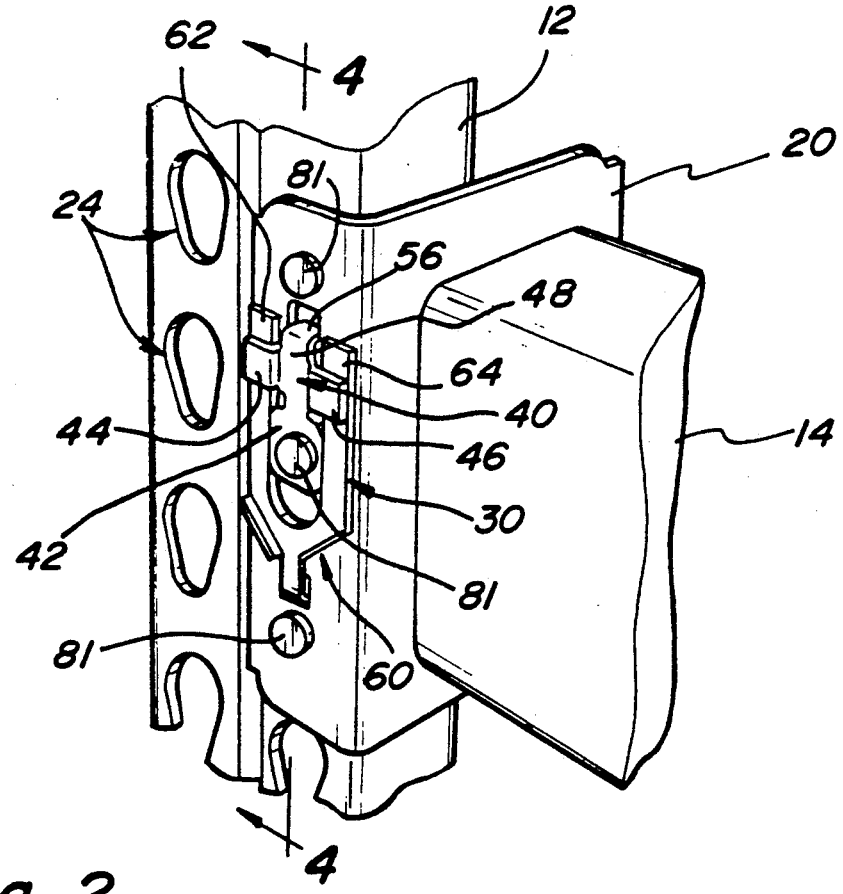
FIG. 2 is an enlarged perspective view of FIG. 1 within Circle 2.
Figure 3:
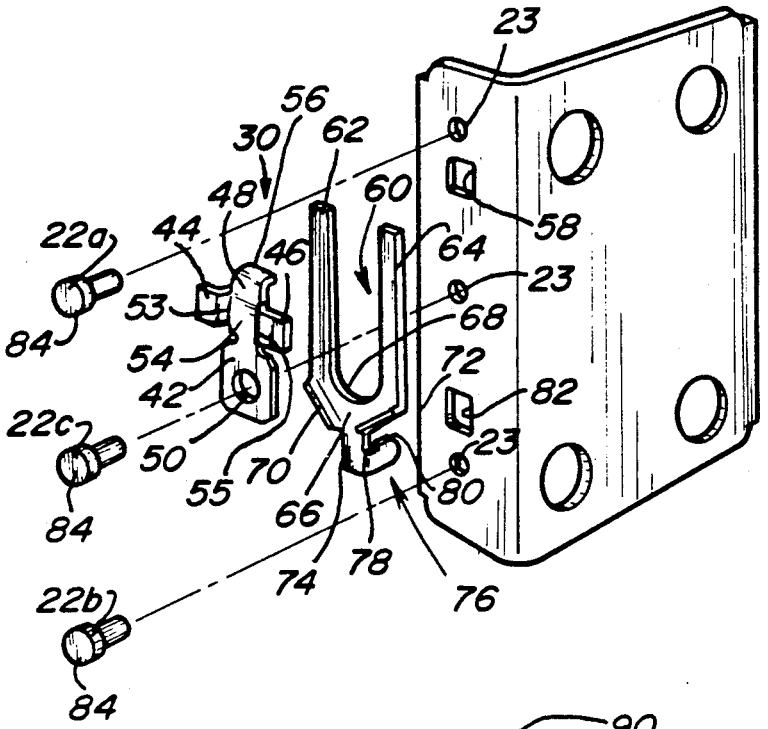
FIG. 3 is an exploded perspective view of the safety lock in accordance with the present invention.
Figure 4:
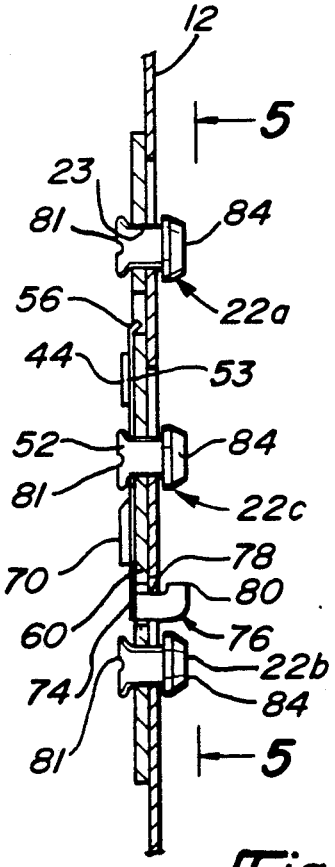
FIG. 4 is a vertical cross-section view of FIG. 2 through a plane defined by line 4—4 thereof.

Cross member legs 44 and 46 transversely extend from the cross member body 54 with respect to the lower leg 42 and oppose one another. The legs 44 and 46 are stamped into the cross member 40 such that raised shoulders 53 and 55 are formed between the legs 44 and 46 and the body 54 to elevate the legs 44 and 46 from the plane of the body 54, as seen in FIGS. 2–4. This elevation enables the hook member 60 to be positioned under the transverse legs 44 and 46. The upper end of the upper leg 48 is bent into an end flange 56. The flange 56 is adapted to be positioned into an aperture 58 in the end connector 20. This positions the cross member 40 relative to the connector prior to stamping the stud **22*c***.

The hook member 60 includes a U-shaped body having a pair of legs 62 and 64 connected by a V-shaped base or web 66. The interior side of the web 68 is continuous with legs 62 and 64 to define an inner edge that closely fits around cross member leg 42, as seen in FIG. 2. The hook member legs 62 and 64 are positioned under cross member legs 44 and 46 to retain the hook member between the end connector 20 and the cross member.

Figure 5:
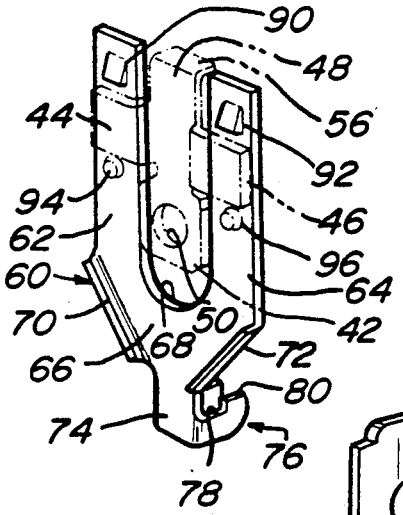
FIG. 5 is a rear perspective view along the direction of the plane defined by line 5—5 of FIG. 4.

The hook member web 66 has bent outer edge flanges 70 and 72 extending from its outer V-sides enabling gripping of the hook member 60. Also the web 66 includes a downwardly extending neck portion 74 whose lower edges are bent perpendicularly to form a pair of hooks 76. (see FIG. 6) The neck 74 is integral with the hook member web 66 and legs 62 and 64 forming the unitary hook member 60. The hooks 76 generally have a receiving portion 78 to enable a portion of the posts 12 to be secured therein, as seen in FIGS. 4 and 5. The tips 80 of the hooks 76 prevent the hooks 76 from being accidentally disengaged from the posts 1 while the hooks 76 are secured thereto.

Generally, the cross member 40 is fixedly positioned upon the end connector 20 with the end flange 56 of the upper leg 48 aligned within aperture 58 and with the stud 22*c* fixed within the connector aperture 23 and cross member aperture 50. The stud 22*c* is stamped or compressed, like a rivet, to expand it and to outwardly deform its end portion 81 to permanently affix the cross member 40 onto the end connector 20. Before expanding the stud, the legs 62 and 64 of the hook member 60 are positioned underneath the legs 44 and 46 of the cross member 40. When the legs 62 and 64 are arranged underneath the legs 44 and 46, the hook 76 extends through a lower aperture 82 (see FIG. 3) formed in the connector 20.

The hook member is made of a springy member, such as spring steel, so that its hooks 76 may be moved relative to the connector 20. In the event that the hook member is bent or otherwise damaged in use, it may be easily removed and replaced. For example, by prying the hook 76 outwardly of the aperture 82 with a coin or screwdriver, the hook member may be slid downwardly from beneath the cross member legs 44 and 46. Then a new hook member may be slid into place.

The end connector 20 is ready to be secured to a frame post 12 to secure the beams 14 to the frame support posts 12. The pins 22*a*, 22*b* and 22*c* on the end connectors 20 are positioned within the inverted teardrop shaped apertures 24 formed in the frame posts 12. Each of the pins has an enlarged head 84 which is inserted through the enlarged upper portion 86 of the aperture 24. When the connector and pins are lowered, the heads are non-removably held by the lower, smaller portions 88 of the apertures 24, as seen in FIG. 5. The hooks 76 resiliently snap into the upper larger portion of the teardrop aperture 86 which it overlaps. The hooks 76 prevent inadvertent removal of the end connectors 20 from the frame posts 12. To disengage the hook members 60 from the frame posts, a screwdriver or a coin or the like can be utilized to pry beneath the flanges 72 or 74 to withdraw the hooks 76 out of the teardrop apertures 24. This enables the pins 22 to be moved from the lower smaller aperture portions 88 upwardly into the larger aperture portions 86 of the teardrop apertures 24 to permit removal of the heads 84 from the teardrop apertures 24.

Figure 6:
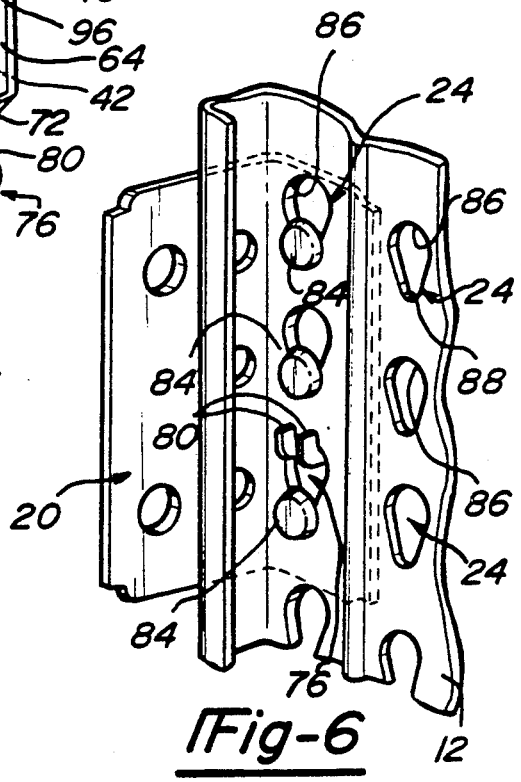
FIG. 6 is another embodiment of the safety lock in accordance with the present invention.

Turning to FIG. 6, a second embodiment of the present invention is shown. FIG. 6 illustrates a hook member 60 similar to that previously described. The elements which are substantially the same as those previously described have been identified with the same reference numerals. The differences of the alternate embodiment will be pointed out below.

The legs 62 and 64 of the U-shaped hook member 60 include struck-out or embossed stop members 90, 92, 94 and 96. Upper stop members 90 and 92 are generally formed near the free extending upper ends of the legs 62 and 64. The members 90 and 92 are struck-out of the legs 62 and 64 and extend from the legs 62 and 64 to form projecting fingers or stops. The fingers 90 and 92 are resilient and deflectable towards and away from the legs 62 and 64. The lower stop members 94 and 96 are stamped into the legs 62 and 64 to form fixed raised nubs. The stop members 90, 92, 94 and 96 prevent movement of the U-shaped hook member 60 once it is positioned under the legs 44 and 46 of the cross member 40. The fingers 90 and 92 deflect, enabling them to pass underneath the leg members 44 and 46. Once passing underneath the legs 44 and 46, the fingers 90 and 92 spring upward and the nubs 94 and 96 contact the lower sides of the legs 44 and 46 to secure the U-shaped hook member 60 in place on the cross member 40, as seen in FIG. 6. Thus, the members 90, 92, 94 and 96 prevent movement of the hook member 60 while it is positioned on the cross member 40 on the end connector 20.

While the above detailed description describes the preferred embodiment of the present invention, it will be understood that the present invention is susceptible to modification, variation and alteration without varying from the scope and fair meaning of the subjoined claims.

What is claimed is:

1. A beam safety lock comprising:

a cross-shaped member including four legs, one of said legs including means adapted for rigidly securing said cross-shaped member onto a stud on a beam; and a U-shaped member including a pair of legs connected by a web and a hook means extending from said web, said legs of said U-shaped member associating with said cross member for operatively coupling said V-shaped member with said cross member, said hook means adapted for cooperating with an aperture in the support for locking the beam with the support.

2. The beam safety lock according to claim 1 wherein a pair of opposite opposing legs of said cross-shaped member are adapted to cooperate with the beam for retaining said U-shaped member on said beam.

3. The beam safety lock according to claim 1 wherein a leg opposing said leg including said securement means includes a turned flange adapted for inserting into an aperture in the beam for positioning said cross-shaped member onto said base.

4. The beam safety lock according to claim 1 wherein said U-shaped member legs include one or more members projecting from each of said legs for securing said legs with said cross member.

5. A beam and frame support system comprising:

one or more beams having one or more end connectors at the beam ends, said end connectors each having one or more pins and one or more apertures;

one or more frame supports, said one or more frame supports each having one or more apertures coupling with said one or more pins of said end connectors of said one or more beams to form a system;

said one or more end connectors including a safety lock means comprised of:

a cross-shaped member including four legs, one of said legs including means adapted for rigidly securing said cross-shaped member onto a stud on a beam; and a U-shaped member including a pair of legs connected by a web and a hook means extending from said web, said legs of said U-shaped member associating with said cross member for operatively coupling said U-shaped member with said cross member said hook means adapted for cooperating with an aperture in the support for locking the beam with the support.

6. The beam safety lock according to claim 5 wherein a pair of opposite opposing legs of said cross-shaped member are cooperating with the end connectors for retaining said U-shaped member on said end connector.

7. The beam safety lock according to claim 5 wherein a leg opposing said leg including said securement means includes a turned flange inserting into an aperture in the end connector for positioning said crossshaped member onto said end connector.

8. The beam safety lock according to claim 5 wherein said U-shaped member legs include one or more members projecting from each of said legs for securing said legs with said cross member.

* * * * *